United States Patent [19]

Silvander

[11] 4,196,557

[45] Apr. 8, 1980

[54] DEVICE FOR END-TO-END CONNECTION OF ELONGATED CONCRETE ELEMENTS

[76] Inventor: Frank O. Silvander, Richertsgatan 10, S-412 50 Göteborg, Sweden

[21] Appl. No.: 912,752

[22] Filed: Jun. 5, 1978

[51] Int. Cl.[2] ..... E04C 3/34; E04C 3/20

[52] U.S. Cl. ..... 52/722; 52/726

[58] Field of Search ..... 52/722, 726, 378, 583, 52/584, 223

[56] References Cited

U.S. PATENT DOCUMENTS

| | | | |
|---|---|---|---|
| 818,884 | 4/1906 | Grimm | 52/722 |
| 3,562,979 | 2/1971 | Ali-Oglu | 52/726 X |
| 4,024,688 | 5/1977 | Calini | 52/726 |

FOREIGN PATENT DOCUMENTS

| | | | |
|---|---|---|---|
| 297046 | 6/1932 | Italy | 52/722 |

*Primary Examiner*—J. Karl Bell

*Attorney, Agent, or Firm*—Ernest A. Beutler

[57] ABSTRACT

An improved joint for end-to-end connection of elongated concrete elements by means of coupling members and connecting elements. The coupling member comprises a sleeve section intended to be threaded on or otherwise secured to reinforcement rods of the elongated concrete elements, such as concrete piles, to be joined together, and a tube section, preferably provided with a head. The connecting element is arranged to engage the stub sections of two oppositely disposed coupling members, thus joining together the elongated elements associated therewith.

14 Claims, 10 Drawing Figures

Fig.5
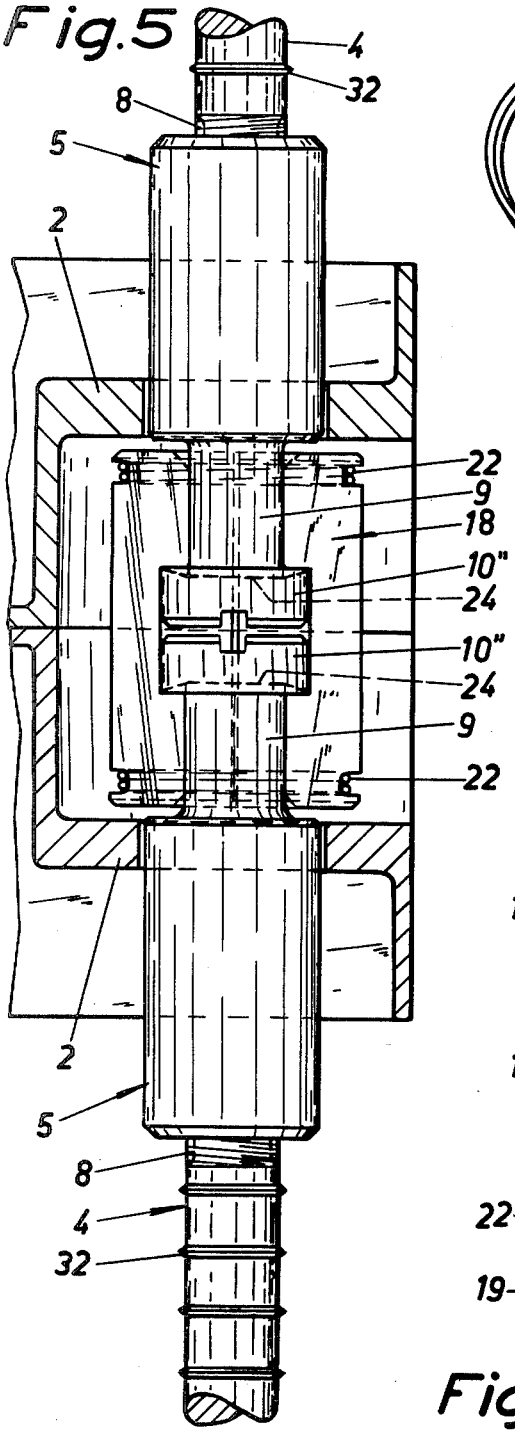
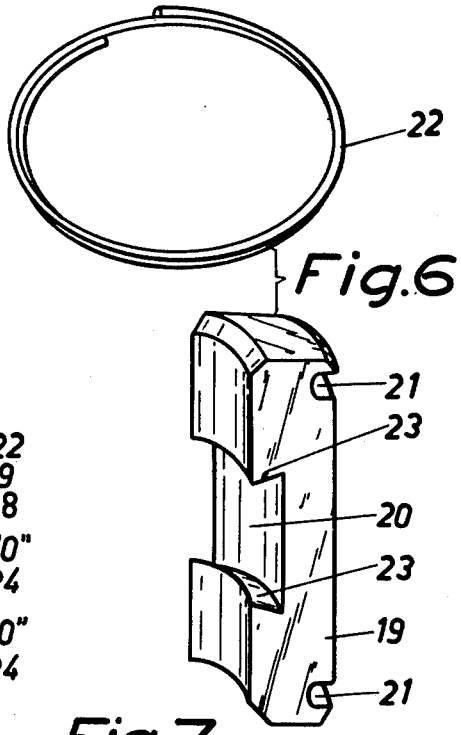
Fig.6
Fig.7
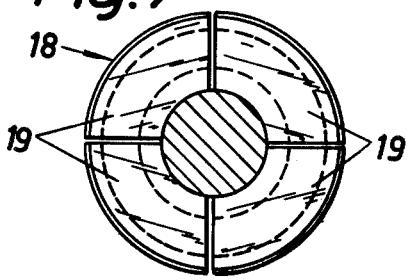
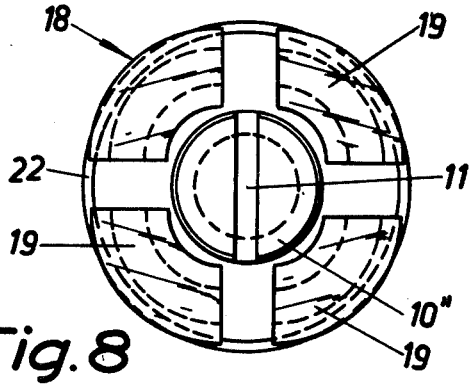
Fig.8

DEVICE FOR END-TO-END CONNECTION OF ELONGATED CONCRETE ELEMENTS

BACKGROUND OF THE INVENTION

The present invention relates to an improvement in end-to-end connection of elongated concrete elements, preferably concrete piles intended for ground reinforcement and similar purposes, which elements are provided with reinforcement rods extending lengthwise through the element and which are joined together at their ends by means of connecting elements.

One technical field wherein various embodiments of end-to-end connections are applied is, as mentioned above, in piles which are rammed into the ground to improve the supporting ability thereof. According to previously known techniques various kinds of connecting elements have been utilized, each one of these elements simultaneously engaging or otherwise interconnecting two pile end shoes positioned in abutting relationship and for this purpose provided with notches, grooves or securement means of some kind of a shape corresponding to that of the connecting element.

The longitudinal reinforcement rods of the concrete pile are usually welded or screwed onto the end shoes.

After the end-to-end connection of two piles to secure them to one another, tension forces occurring in the piles will consequently spread out from the reinforcement rods of one pile by way of the end shoe thereof, the connecting element between this pile, and the adjacent end shoe of the other opposite pile and finally by way of the last-mentioned end shoe continue to the reinforcement rods of the second pile.

Independently of the kind of connecting element which is used in this type of end-to-end connection the latter suffers from considerable disadvantages because of the long path over which the forces are transferred from one concrete element to the next when flexural stress occurs in the joint, which leads to very disadvantages moments with consequential risks of breaks of the joint.

It has been found that welding the end shoes to the reinforcement rods in concrete piles makes the reinforcement quite unflexible. When interconnected piles are exposed to impact while being rammed into the ground, the concrete layers closest adjacent to the end shoes usually are reduced to powder. As a result, at the end of a series of blows from the pile-driver, the end shoes have a tendency to move somewhat in the longitudinal direction of the piles relative to the reinforcement rods. Should such relative movements not be possible because the reinforcement rods and the end shoes are securely anchored to each other, such a non-flexible joint often would result in bending of the reinforcement rods immediately internally of one or several of the end shoes, and in several cases the concrete pile will be cracked open on one side. This is, of course, quite satisfactory.

SUMMARY OF THE INVENTION

The present invention provides a device by which end-to-end connection of elongated concrete elements, preferably piles, is considerably simplified and improved while at the same time the disadvantages outlined above are eliminated. The invention is essentially characterised in that the reinforcement rods are provided at each end with a coupling member and that each connecting element is arranged to interconnect the coupling members of two reinforcement rods disposed in alignment with their end faces facing each other, the interconnection being such that any tension forces occurring in the concrete elements are transferred directly from the reinforcement rod in one concrete element to the reinforcement rod of the opposite concrete element while allowing relative displacement of the reinforcement rods upon the occurrence of stress from pressure or impact. A joint connection of this kind eliminates the aforementioned disadvantageous moment that they arise upon the occurrence of tension forces.

Because the joint connection in accordance with the invention further permits relative movement between the reinforcement rods, any shock waves that propagate through the joints when the concrete piles are being driven down into the ground, will be absorbed practically exclusively by the concrete. The novel jointing principle consequently reduces to a minimum the risk of bending of the reinforcement rods during the pile-driving operation.

BRIEF DESCRIPTION OF THE DRAWINGS

The improved joint in accordance with the invention will be described in closer detail in the following with reference to the accompanying drawings illustrating by way of example some embodiments of the joint used in end-to-end connection of concrete piles. In the drawings FIG. 5 illustrates a vertical section through a joint connection in accordance with a third embodiment, FIG. 6 illustrates individual parts of a connecting element provided in this third embodiment, FIGS. 7 and 8 illustrate this connecting element from above in different positions.

DETAILED DESCRIPTION OF PREFERRED EMBODIMENTS

Figure 1:
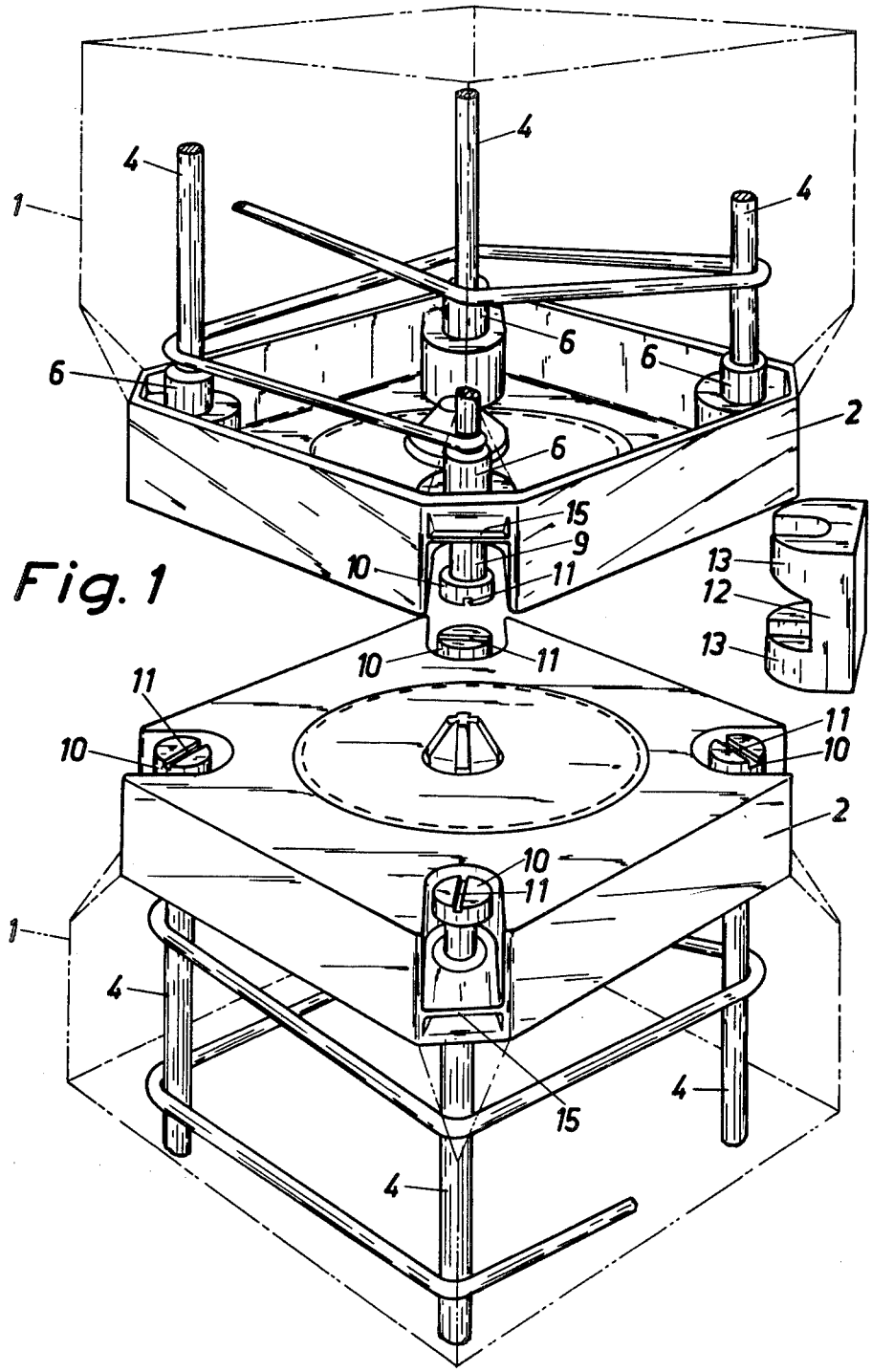
FIG. 1 illustrates in a perspective view two concrete piles with their end faces facing each other.

FIG. 1 illustrates in a perspective view the facing ends of two oppositely disposed piles 1 which are provided with end shoes 2 in the form of a plate. The piles 1 are cast from concrete, each having embedded therein a reinforcement structure comprising four longitudinally extending reinforcement rods 4.

The joint connection in accordance with a first embodiment thereof includes a coupling member in the form of a stub sleeve 5 (see FIG. 2) comprising a sleeve section 6 provided with an internal screw thread 7. The free end of each reinforcement rod 4 is provided with a screw threaded section 8 onto which the sleeve section 6 of the stub sleeve is arranged to be screwed.

The stub sleeve 5 further comprises a stub section 9. According to FIG. 2, this stub section 9 supports a bolt head 10 in which a screw driver slot 11 is provided for facilitating screwing the stub sleeve 5 onto the reinforcement rod 4.

Figure 2:
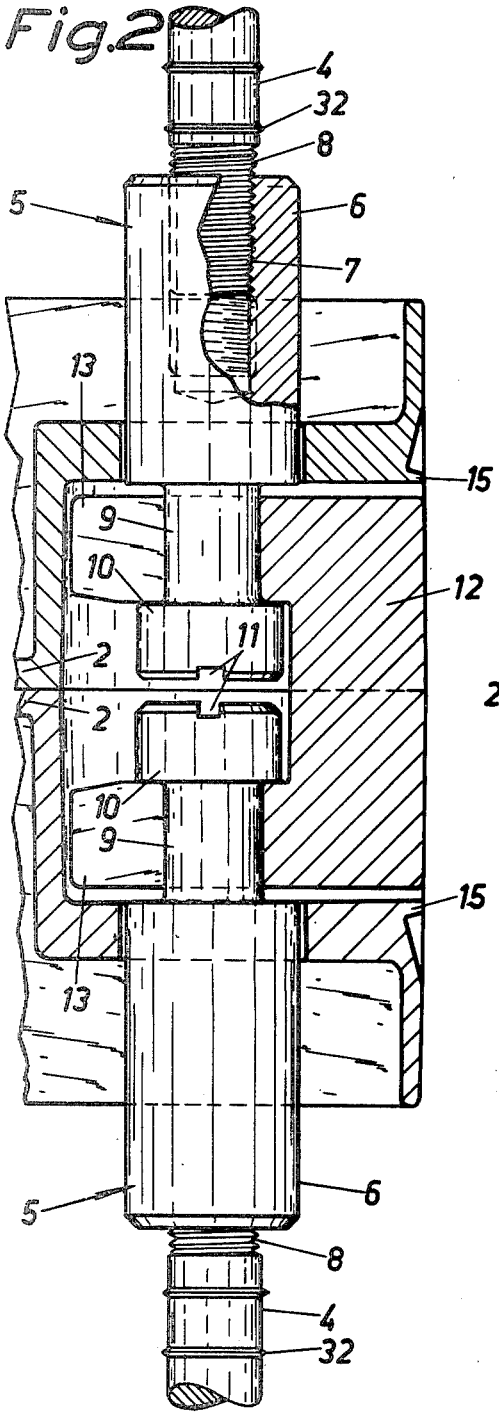
FIG. 2 illustrates a vertical section through a joint in accordance with a first embodiment of the invention.
Figure 3:
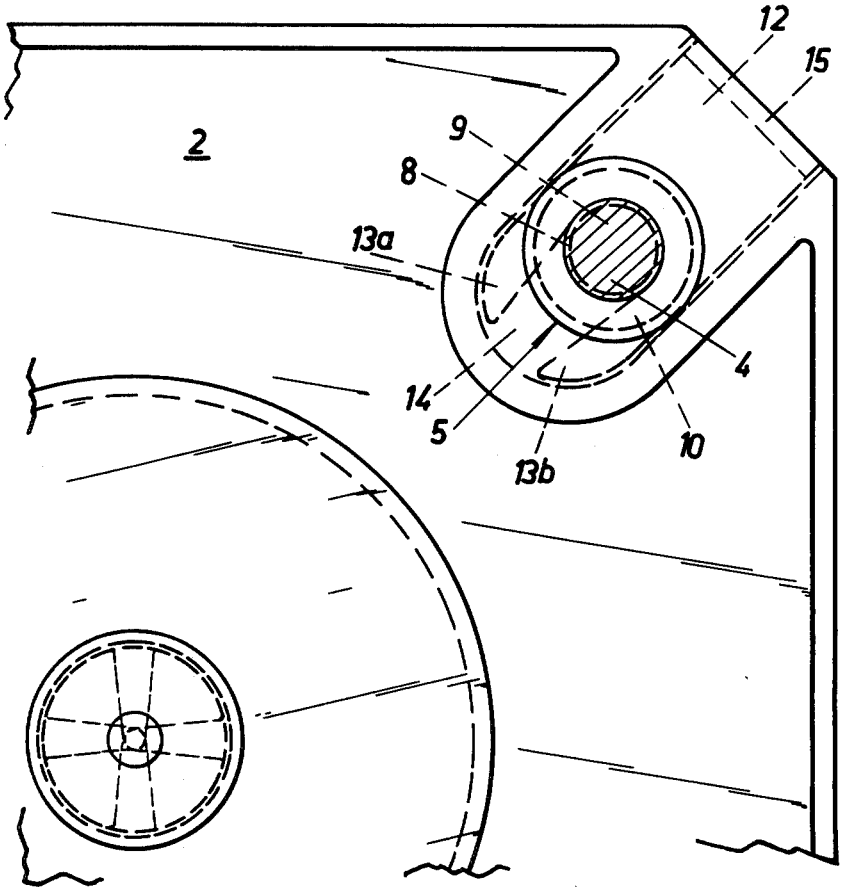
FIG. 3 illustrates in a plan view and on an enlarged scale a corner of a pile equipped with this joint connection.

Furthermore, the joint connection comprises a jointing element which, in accordance with the embodiment illustrated in FIG. 2, is in the form of a U-shaped member 12 having two limbs 13 which extend parallel to each other. This U-shaped member 12 is arranged to engage its two limbs 13 behind the bolt heads 10 of two oppositely disposed stub sleeves 5, thus forming the connecting element proper between two piles. The limbs 13 of the U-shaped member are provided with a central groove 14 (see FIG. 3), whereby the two limb sections 13*a*, 13*b* on either side of this groove may engage behind a bolt head 10, laterally embracing the stub section 9.

For effecting an end-to-end connection of two aligned and opposite disposed concrete piles, the limbs 13 of the U-shaped connecting element 12 are inserted behind the bolt heads 10 of two mutually facing stub sleeves 5. The limbs 13 preferably diverge slightly in the direction of their free ends, thus giving the stub sleeves certain degree of prestress, which improves on the connective strength of the connection. When the U-shaped member has been attached, a flanging edge is bent at the top and bottom of the outer edge of the plate 2, thus preventing the member 12 from sliding out of engagement.

Figure 4:
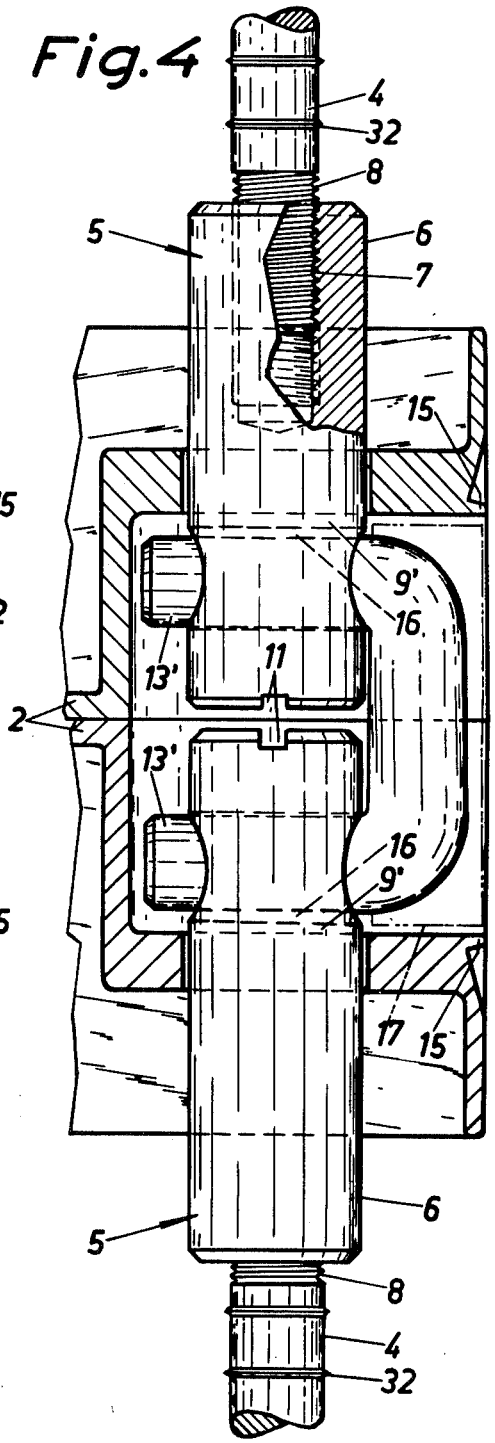
FIG. 4 illustrates a vertical section through a joint connection in accordance with a second embodiment.

FIG. 4 illustrates a second embodiment of the joint connection in accordance with the invention. According to this embodiment the stub sleeve 5 is provided with a stub section 9' through which passes a bore 16. The U-shaped member 12' consists in this embodiment of a steel rod the ends of which are bent to form two, preferably slightly diverging limbs 13'. The limbs 13' of this member 12' are inserted into the bores 16 and in this manner the member 12' forms a connecting element between two stub sleeves 5. For the purpose of retaining the member 12' securely in its position interlocking two stub sleeves, an insert 17 may be disposed on top of the member 12' and flange edges 15 be upended inwards towards the insert in a manner similar to the previously described embodiment.

FIGS. 5 to 8 of the drawings illustrate a third embodiment. In this embodiment the connecting element consists of an expansible sleeve 18. In accordance with the embodiment shown, this sleeve comprises four sleeve segments 19 which, when put together, form a sleeve having a central through-passage opening therein. Each sleeve segment 19 is provided on its inside with a recess 20 which together with the corresponding shaped recesses of the other sleeve segments forms a space which serves for receiving the oppositely disposed bolt heads 10'' of two facing stub sleeves 5. The sleeve segments 19 are provided on their outside with grooves 21 serving to receive spring means 22 extending around the sleeve at the top as well as at the bottom thereof.

In order to effect an end-to-end connection of two piles by means of such an expansible sleeve 18, the sleeve is initially pressed onto the bolt head 10'' of the stub sleeve 5 of the first pile, whereby the sleeve widens from the position illustrated in FIG. 7 to that illustrated in FIG. 8. As soon as the bolt head 10'' is housed inside the recesses 20, the sleeve segments retract resiliently. Thereafter, the connection is effected by positioning the bolt head 10'' on the stub sleeve 5 of the second pile which is to be connected endwise to the first pile, in alignment in front of the sleeve 18 whereafter the second concrete pile is moved into engagement with the first one. During the movement, the bolt head 10'' of the second pile will by itself penetrate into the sleeve 18 until it reaches the space formed by the four recesses 20, and in this position the sleeve again retracts about the two bolt heads 10''.

It may be convenient to construct the edges 23 of the recesses in such a manner that they converge slightly in the direction towards the opening between them and at the same time to shape the rear faces 24 of the bolt heads 10'' in a concave manner. When tension forces occur in the connection, the bolt heads 10'' will tend, because of this shaping, to hold the sleeve segments 19 safely together, which thus ensures very satisfactory retention.

Figure 9:
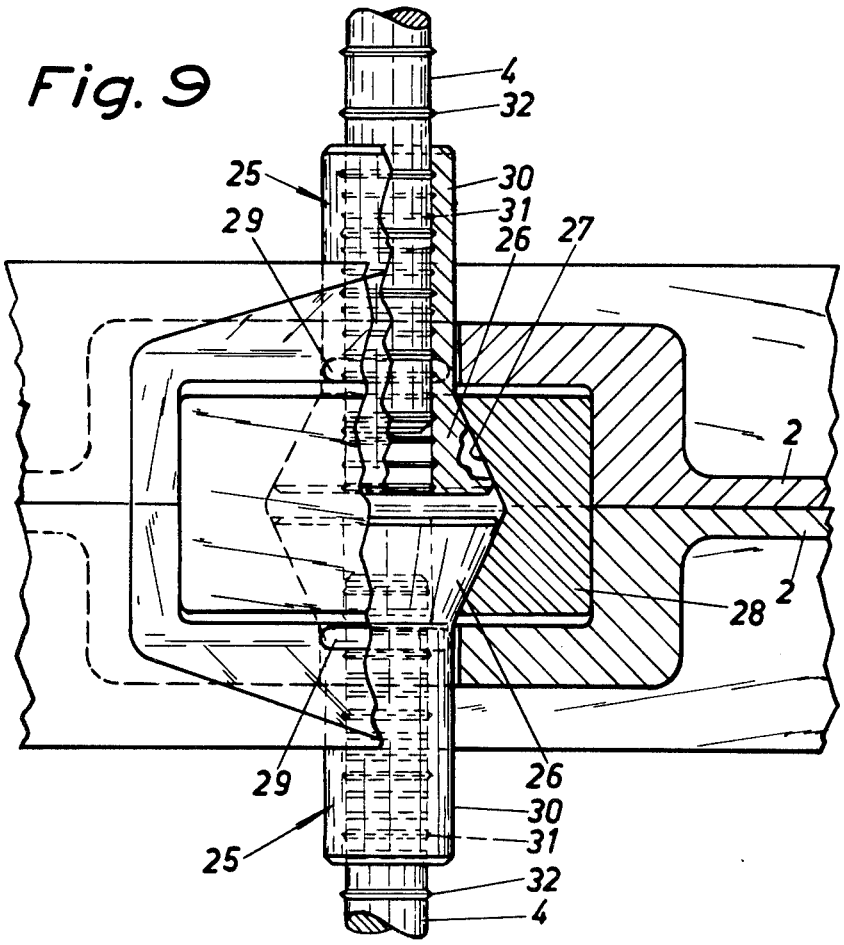
FIG. 9 is a vertical section through a joint connection in accordance with a fourth embodiment.
Figure 10:
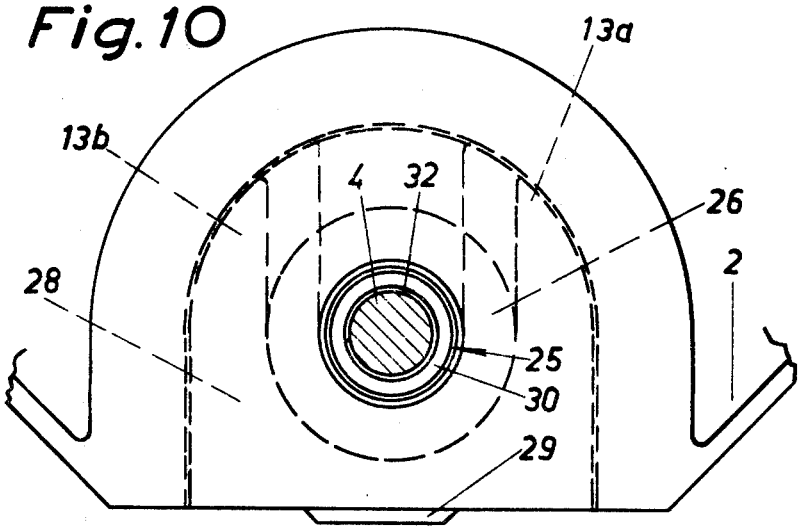
FIG. 10 is a plan view of the joint connection of FIG. 9.

FIGS. 9 and 10 illustrate a fourth embodiment. In this embodiment, the coupling member consists of a stub sleeve 25 having a conical head 26 which tapers in the direction towards the reinforcement rod 4 with which the coupling member is connected. The conical head 26 is supported in a seat 27 of corresponding conical shape and formed in a connecting element 28 of U-shaped configuration when seen from above. When applied in position in the joint, this connecting element 28 will engage the two heads 26 of two oppositely positioned coupling members 25. By upsetting beads 29 formed in the end shoes 2 above and below the connecting element 28, the latter is retained safely in position about the coupling members 25.

In accordance with this latter embodiment the coupling member 25 is imagined to be manufactured from steel having a tensile strength of 700 to 900 $N/mm^2$, which is a much harder material than that used for the reinforcement rods 4. One has found in practice that by merely forcing or upsetting the sleeve portion 30 of the coupling member 25 onto the reinforcement rod 4 a safe connection between these details is obtained which is capable of withstanding considerable tension forces that may occur in the pile joint. However, it is preferable to provide the sleeve portion 30 with internal transverse grooves 31 spaced closer to one another than the cam ridges 32 that normally are provided on the reinforcement rods 4. When a sleeve portion 30 of a coupling member 25 is forced onto a reinforcement rod 4 at least a few cam ridges 32 will be seated in their respective grooves 31, thus further increasing the tensile breaking strength of the coupling member and the reinforcement rod.

All of the embodiments described above have the important advantage that the connection occurs directly from the reinforcement of one concrete pile to the reinforcement of the opposite concrete pile without any coupling by way of the end shoes 2. This increases the ability of the connection to absorb tensile forces as compared with prior-art joints. In addition, the connection becomes very rigid. On the other hand, because of the possibility of relative movements between oppositely positioned coupling members the forces generated by impacts will propagate from one pile to the next on the whole directly through the concrete, thus relieving the reinforcement rods which therefore do not tend of bend.

A secondary advantageous effect is gained by the arrangement in accordance with the subject invention in that the end shoes 2, generally provided on concrete piles, no longer need to be heavily dimensioned as they do not serve as fastening means. Instead they can be made very thin and under certain conditions be completely eliminated, if desired. It should be obvious without further that considerable savings in material are gained.

The invention is not limited to the embodiments illustrated and described but could be changed in a variety of ways within the scope of the inventive idea. For example, the coupling member as well as the connecting element may be constructed differently.

The invention is not either in any way limited to application in piles but the connecting element in accordance with the invention is equally applicable to other concrete elements such as beams, pillars, poles and similar elements. As one example of such use could be mentioned the roof-trusses to be erected in new buildings. When the buildings are large, the work of transporting the roof-trusses to the building site and of erecting them becomes very damanding. Owing to the arrangement in accordance with the subject invention it becomes possible to transport separate concrete elements to the building site and to assemble the elements into roof-trusses in situ with the aid of connecting elements in accordance with the invention.

The advantage of not having to transport very long units can be made use of also in other fields, such as e.g. in power line poles, and similar elongated objects.

What I claim is:

1. An improved device for end-to-end connection of elongated concrete elements such as concrete piles intended for ground reinforcement and similar purposes, said concrete elements having embedded herein reinforcement rods extending lengthwise through said elements, connecting elements for joining together the ends of said concrete elements, the improvement comprising a coupling member provided on each end of said reinforcement rods, said connecting element having means for interconnecting the coupling members of two reinforcement rods disposed in alignment with their end faces facing each other, said means being operative to transmit tension forces occurring in said concrete elements directly from a reinforcement rod disposed in one concrete element to the reinforcement rod of the oppositely disposed concrete element and for permitting relative axial displacement of said reinforcement rods to each other upon the occurrence of a compression force on one of the concrete elements.

2. An improveed device as claimed in claim 1, wherein said coupling member is in the form of a stub sleeve, said stub sleeve comprising a sleeve portion connected to said end of a reinforcement rod, and a stub portion connected to said connecting element.

3. An improved device for end-to-end connection of elongated concrete element such as piles intended for ground reinforcement and similar purposes, said concrete elements having embedded therein reinforcement rods extending lengthwise through said elements, connecting elements for joining together the ends of said concrete elements, the improvement comprising a coupling member provided on each end of said reinforcement rods, each of said coupling members being in the form of a stub sleeve comprising a sleeve portion connectable to the respective reinforcement rod end, and a stub portion connectable to said connecting element, said connecting element having means for interconnecting the coupling members provided on said ends of two reinforcement rods disposed in alignment with their end faces facing each other, said means being operative to transmit tension forces occurring in said concrete elements from said reinforcement rod disposed in one concrete element to said reinforcement rod of the oppositely disposed concrete element and for permitting relative displacement of said reinforcement rods upon the occurrence of a compressive force on one of the concrete elements.

4. An improved device as claimed in claim 3, wherein said sleeve portion of said stub sleeve is screwed onto the associated reinforcement rod end to secure said stub sleeve to said reinforcement rod.

5. An improved device as claimed in claim 3, wherein said stub sleeve is made from a material that is harder than that of said reinforcement rod, said sleeve portion of said stub sleeve being pressed onto said reinforcement rod to secure said stub sleeve thereto.

6. An improved device as claimed in claim 3, comprising internal, transverse grooves in said stub sleeve, and transverse cam ridges formed on said reinforcement rod, said cam ridges arranged to engage in said grooves in said stub sleeve, to secure said sleeve to said rod.

7. An improved device as claimed in claim 3, comprising a bolt head on said stub portion of said stub sleeve, said connecting element being in the form of a U-shaped member, the two limbs of said U-shaped member extending in the same direction and arranged to engage behind the bolt heads of two stubs sleeves disposed in facing relationship.

8. An improved device as claimed in claim 7, comprising a central groove in said limbs of said U-shaped member, and two limb sections on either side of said groove, said limb sections arranged to engage behind said bolt head so as to laterally embrace the associated stub portion.

9. An improved device as claimed in claim 7, comprising bores provided in said stub portions of two oppositely disposed stub sleeves, said limbs of said U-shaped member arranged to be inserted in said bores.

10. An improved device as claimed in claim 7, wherein said limbs of said U-shaped member diverge slightly in the direction of their free ends.

11. An improved device as claimed in claim 8, wherein said limbs of said U-shaped member diverge slightly in the direction of their free ends.

12. An improved device as claimed in claim 9, wherein said limbs of said U-shaped member diverge slightly in the direction of their free ends.

13. An improved device as claimed in claim 3, comprising an expansible sleeve forming said connecting element, said expansible sleeve consisting of a plurality of sleeve segments, resilient members provided to hold together said sleeve segments in the form of a sleeve, said sleeve segments, when put together in sleeve form, delimiting between them a through-passage, said through-passage widening at the centre portion of said sleeve into a space serving for reception therein of the facing bolt heads of two oppositely disposed stub sleeves.

14. An improved device as claimed in claim 3, comprising a conical head on said stub sleeve, said conical head tapering in the direction towards the reinforcement rod with which said stub sleeve is connected, a seat of a corresponding conical shape formed in said connecting element joining together two oppositely disposed stub sleeves, said conical head freely supported in said conical seat.

* * * * *